United States Patent [19]

Donauer et al.

[11] Patent Number: 5,056,310

[45] Date of Patent: Oct. 15, 1991

[54] EXHAUST PIPE FOR A MULTI-CYLINDER PISTON INTERNAL-COMBUSTION ENGINE

[75] Inventors: Georg Donauer; Otto Reifenscheid, both of Friedrichshafen, Fed. Rep. of Germany

[73] Assignee: MTU Motoren- und Turbinen- Union Friedrichshafen GmbH, Fed. Rep. of Germany

[21] Appl. No.: 499,303

[22] PCT Filed: Dec. 14, 1989

[86] PCT No.: PCT/DE89/00771

§ 371 Date: May 17, 1990

§ 102(e) Date: May 17, 1990

[87] PCT Pub. No.: WO90/08250

PCT Pub. Date: Jul. 26, 1990

[30] Foreign Application Priority Data

Jan. 13, 1989 [DE] Fed. Rep. of Germany ..... 3900830

[51] Int. Cl.[5] ..... F01N 7/10

[52] U.S. Cl. ..... 60/322; 60/323

[58] Field of Search ..... 60/322, 323

[56] References Cited

U.S. PATENT DOCUMENTS

| | | | |
|---|---|---|---|
| 3,703,083 | 11/1972 | Tadokoro | 60/323 |
| 3,994,129 | 11/1976 | Sakurai | 60/323 |
| 4,205,527 | 6/1980 | Rudert | 60/322 |
| 4,458,491 | 7/1984 | Deutschmann | 60/323 |
| 4,658,580 | 4/1987 | Schley | 60/322 |
| 4,807,436 | 2/1989 | Deutschmann | 60/322 |
| 4,869,064 | 9/1989 | Deutschmann | 60/322 |

*Primary Examiner*—Douglas Hart

*Attorney, Agent, or Firm*—Evenson, Wands, Edwards, Lenahan & McKeown

[57] ABSTRACT

An interior pipe carrying exhaust gases is arranged in a cooled housing 13. The interior pipe fastened to the housing 13 comprises individual sections 18 arranged in series while leaving expansion joints. The length of one section 18 corresponds approximately to the cylinder spacing of the piston internal-combustion engine. At the circumference, at the halfway point of its length, each section 18 has a plug-type connection 20 interacting with the housing. This plug-type connection 20 is arranged approximately opposite the lead-in point of an exhaust stub 15 of a cylinder interacting with the section 18. The plug-type connection 20 comprises a receiving device which, in a cooled manner, is arranged in the housing and a corresponding plug 23 connected with the section 18 of the interior pipe. When the operating temperature of the interior pipe is reached, the plug-type connection 20 causes a support against the housing 13, whereby an excitation of vibrations of the sections 18 of the interior pipe by the impinging pulsating exhaust gas flow is avoided.

3 Claims, 3 Drawing Sheets

EXHAUST PIPE FOR A MULTI-CYLINDER PISTON INTERNAL-COMBUSTION ENGINE

BACKGROUND AND SUMMARY OF THE INVENTION

The invention relates to an exhaust pipe for a multi-cylinder piston internal-combustion engine having at least one interior pipe carrying the exhaust gases and having a gastight cooled housing which surrounds the interior pipe at a distance, the interior pipe fastened to the surrounding housing comprising individual sections arranged in series while leaving expansion joints, the length of each section corresponding approximately to the cylinder spacing of the piston internal-combustion engine, and each section having a plug-type connection which interacts with the housing at approximately the halfway point of its length, at the outer circumference. An exhaust pipe of that type has a very low surface temperature so that a piston internal-combustion engine equipped with it meets the requirements for an unmonitored operation.

An exhaust gas pipe of this type is known from the German patent document DE 34 45 017 C1. The plug-type connection at the exhaust gas outlet of every cylinder which interacts with the housing has in each case the object of fixing the section of the interior pipe in the longitudinal and in the circumferential direction. The excitation of vibrations of the interior pipe resulting from the pulsating exhaust gas flow cannot be prevented by the known arrangement. The reason is that the plug-type connection has a play between the interior part and the exterior part in all operating conditions, whereby a vibration-reducing support of the sections of the interior pipe becomes impossible.

It is therefore an object of the invention to further develop the exhaust pipe of a multi-cylinder piston internal-combustion engine having an interior pipe carrying the exhaust gases and having a gastight housing surrounding this pipe at a distance so that an excitation of vibrations of the interior part caused by the exhaust gas flow is avoided.

According to the invention, this object is achieved by means of the characterizing part of claim 1 and is further developed by means of the characterizing parts of claims 2 and 3.

An arrangement wherein the plug-type connection is arranged approximately opposite the lead-in point of an exhaust stub of a cylinder interacting with the section, wherein the plug-type connection comprises a receiving device arranged in the housing in a cooled manner and a corresponding plug which is connected with the section of the interior pipe.

In certain preferred embodiments, the receiving device is a flange busing having a bottom which is inserted in a sealing manner into an opening of the cooled interior wall of the housing. In certain preferred embodiments, the plug is fastened in a detachable manner to the section of the interior pipe by means of a screwed connection.

The support of the sections of the interior pipe by means of the plug-type connection approximately perpendicularly to its longitudinal course at the housing is ineffective in the cold condition because a play exists between the receiving device and the plug. This support will start only when, as a result of the thermal expansion difference, the play in the plug-type connection is eliminated. As a result, the sections of the interior pipe are not supported at the housing before an operating temperature is reached at which an excitation of vibrations would be critical. However, during the warm-up phase of the exhaust pipe, the thermal expansion of the sections of the interior pipe is not hindered.

The advantages achieved by means of the invention are that the plug-type connection has a self-adjusting effect; that the plug-type connection of the interior pipe is easy to mount; and that, particularly when the exhaust pipe is arranged with two opposite obliquely entering exhaust gas outlets of cylinders, the excitation of vibrations of the interior pipe is avoided.

Other objects, advantages and novel features of the present invention will become apparent from the following detailed description of the invention when considered in conjunction with the accompanying drawings.

DETAILED DESCRIPTION OF THE DRAWINGS

Figure 1:
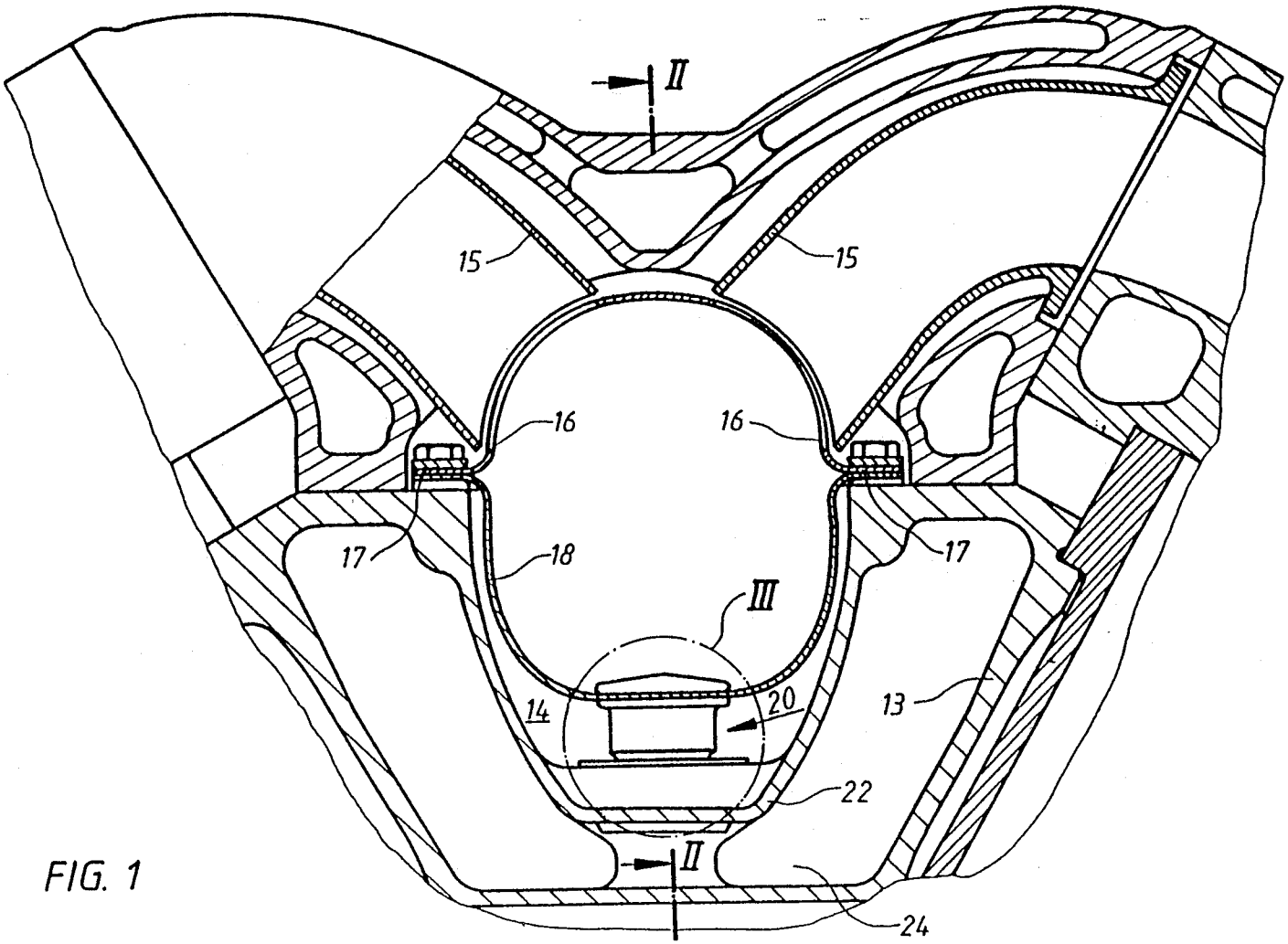
FIG. 1 is a partial longitudinal sectional view of a piston internal-combustion engine, constructed according to a preferred embodiment of the invention, taken along line I—I in FIG. 2.
Figure 2:
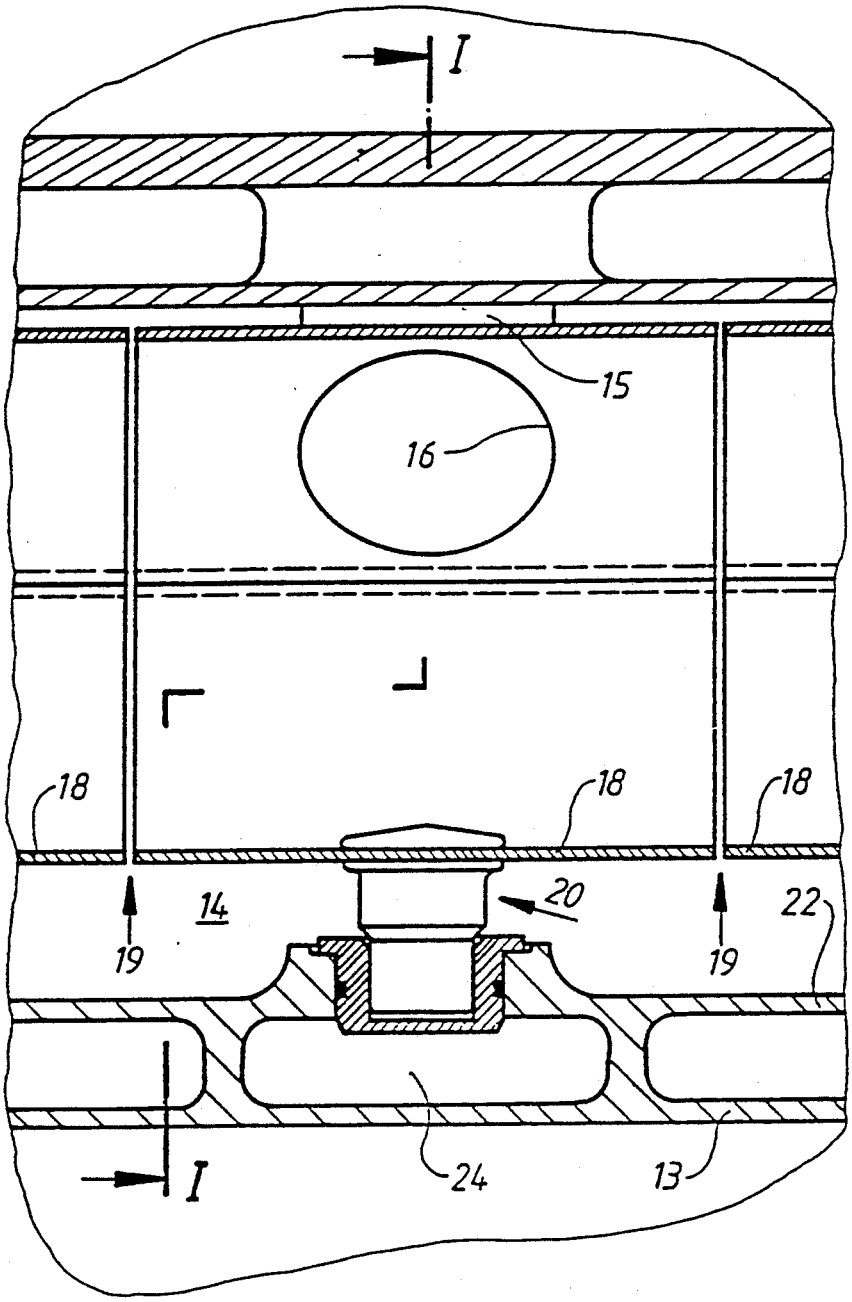
FIG. 2 is a partial cross-sectional view of a piston internal-combustion engine taken along Line II—II in FIG. 1.
Figure 3:
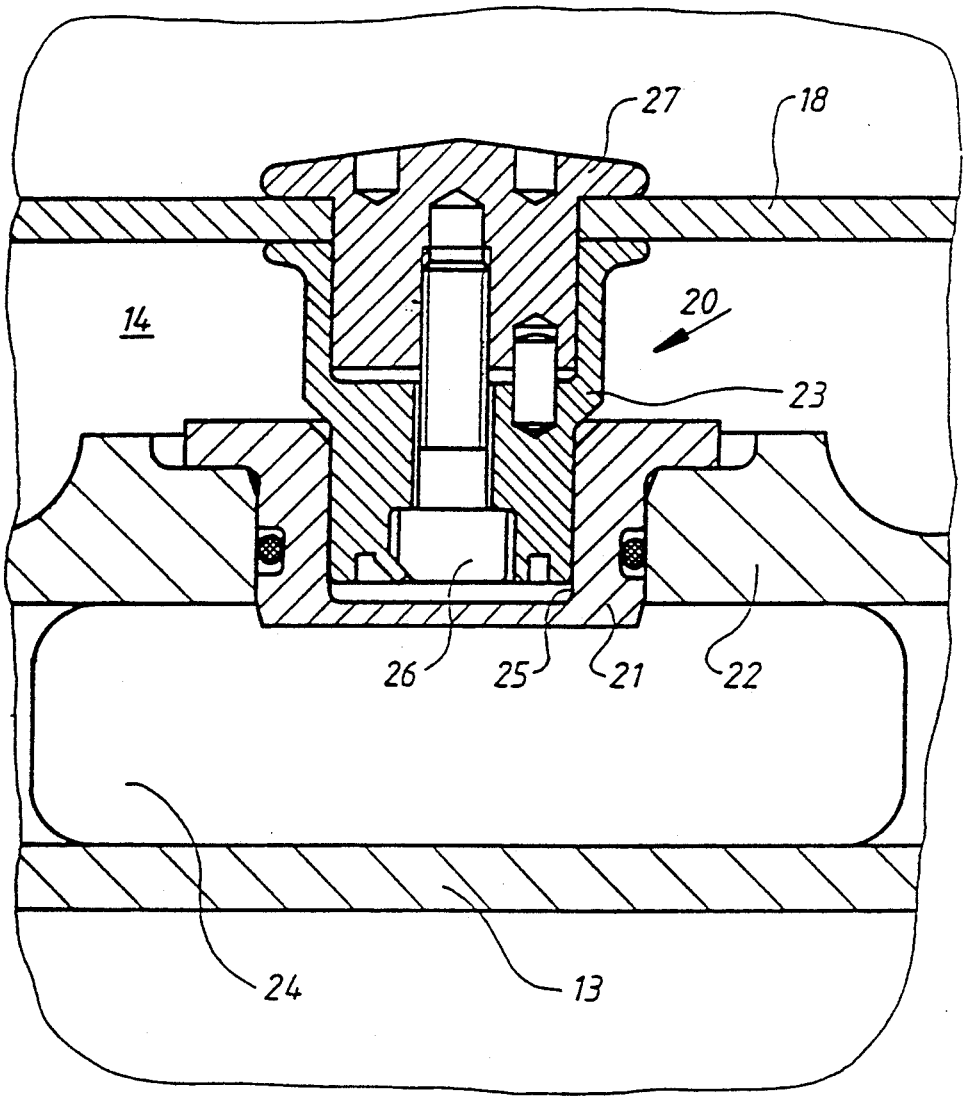
FIG. 3 is a representation of a detail of a plug-type connection according to the Detail III in FIG. 1.

The bottom part of a liquid-cooled housing for receiving an interior pipe formed of sections 18 for the exhaust gases of a multi-cylinder piston internal-combustion engine is formed by the space 14 of the cylinder block and crankcase 13 between the cylinder banks arranged in a V-shape. The length of the sections 18 of the interior pipe corresponds approximately to the cylinder spacing of the piston internal-combustion engine. Each section 18 of the interior pipe, approximately in the center of its length, has two exhaust gas inlet openings 16 arranged opposite one another, one exhaust gas stub 15 respectively of one cylinder of each cylinder row obliquely leading into the exhaust gas inlet opening 16. The sections 18 of the interior pipe, by way of flanges 17, are fastened at the cylinder block and crankcase 13 approximately in the center of their length. The front faces of the sections 18 face one another at a distance 19 which at operating temperature is reduced almost to zero as a result of thermal expansion. The pulsating exhaust gas flow from the exhaust gas stubs 15 flowing obliquely to the fastening at the flanges 17 which alternately impinges on the sections 18 causes an excitation of vibrations of the interior pipe. As a result of a diminishing strength of material when a component is heated intensively, vibrations of the interior pipe may endanger the operation when the operational temperature of approximately 700° is reached.

Approximately opposite the exhaust gas inlet openings 16, each section 18 of the interior pipe, is connected perpendicularly to its longitudinal course with the cylinder block and crankcase 13 by means of a plug-type connection 20. The plug-type connection 20 comprises a flange bushing 21 which is inserted and fastened in the cooled wall 22 of the cylinder block and crankcase 13, as well as a plug 23 fastened to the section 18. With its bottom, the flange bushing 21 projects into the cooling duct 24 of the cylinder block and crankcase 13 and as a result is cooled intensively. The plug 23, which corresponds with the receiving bore 25 of the flange bushing 21, is detachably fastened to the wall of the section 18 by means of a screw 26 and counterholders 27.

In the cold condition of the exhaust pipe, a loose fit exists between the receiving bore 25 in the flange bushing 21 and the plug 23 which ensures a simple mounting of the interior pipe.

During the operation of the piston internal-combustion engine, the plug 23 is intensely heated by the exhaust heat of the interior pipe. As a result of the rise in temperature, the diameter of the plug 23 increases by thermal expansion. Because of the intensive cooling, the warming of the flange bushing 21 is less than that of the plug 23. This results in a thermal expansion difference which uses up the initially existing play and leads to a firm fit of the plug 23 in the flange bushing 21. As a result, the vibration-reducing support of the sections 18 of the interior pipe with respect to the housing will start when the interior pipe reaches its critical operating temperature. If the exhaust pipe cools down during interruptions of the operation, the tight fit of the plug 23 is loosened again.

By means of the selection of the initial play between the flange bushing 21 and the plug 23, the start of the tight fit of the plug-type connection can be determined for a desired temperature level.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. An exhaust pipe for a multi-cylinder piston internal-combustion engine having at least one interior pipe carrying the exhaust gases and having a gastight cooled housing which surrounds the interior pipe at a distance, the interior pipe fastened to the surrounding housing comprising individual sections arranged in series while leaving expansion joints, the length of each section corresponding approximately to the cylinder spacing of the piston internal-combustion engine, and each section having a plug-type connection which interacts with the housing at approximately the halfway point of its length, at the outer circumference, wherein the plug-type connection 20 is arranged approximately opposite the lead-in point of an exhaust stub 15 of a cylinder interacting with the section 18, wherein the plug-type connection 20 comprises a receiving device arranged in the housing in a cooled manner and a corresponding plug 23 which is connected with the section 18 of the interior pipe.

2. An exhaust pipe according to claim 1, wherein the receiving device is a flange bushing 21 having a bottom which is inserted in a sealing manner into an opening of the cooled interior wall 22 of the housing.

3. An exhaust pipe according to claim 1, wherein the plug 23 is fastened in a detachable manner to the section 18 of the interior pipe by means of a screwed connection.

* * * * *